US009322414B2

(12) United States Patent
Eckert

(10) Patent No.: US 9,322,414 B2
(45) Date of Patent: Apr. 26, 2016

(54) TURBOMACHINE

(71) Applicants: Duerr Cyplan Ltd., Reading Berkshire (GB); Frank Eckert, Bad Lobenstein (DE)

(72) Inventor: Frank Eckert, Bad Lobenstein (DE)

(73) Assignee: DUERR CYPLAN LTD., Reading Berkshire (GB)

( * ) Notice: Subject to any disclaimer, the term of this patent is extended or adjusted under 35 U.S.C. 154(b) by 715 days.

(21) Appl. No.: 13/718,582

(22) Filed: Dec. 18, 2012

(65) Prior Publication Data

US 2013/0129496 A1 May 23, 2013

Related U.S. Application Data

(63) Continuation-in-part of application No. PCT/EP2011/074330, filed on Dec. 30, 2011.

(30) Foreign Application Priority Data

Dec. 30, 2010 (DE) ..... 10 2010 056 557
Dec. 30, 2010 (DE) ..... 20 2010 017 157 U

(51) Int. Cl.
*F04D 29/54* (2006.01)
*F01D 1/08* (2006.01)
*F01D 25/30* (2006.01)

(52) U.S. Cl.
CPC *F04D 29/54* (2013.01); *F01D 1/08* (2013.01); *F01D 25/30* (2013.01)

(58) Field of Classification Search
CPC ..... F01D 1/08; F01D 25/30; F04D 29/44; F04D 29/444; F04D 29/54; F04D 29/542
See application file for complete search history.

(56) References Cited

U.S. PATENT DOCUMENTS 2,949,224 A 8/1960 Pavlecka
4,428,715 A 1/1984 Wiggins
(Continued)

FOREIGN PATENT DOCUMENTS

GB 492144 A 9/1938
GB 877988 A 9/1961
(Continued)

OTHER PUBLICATIONS

International Search Report dated Apr. 17, 2012 of international application PCT/EP2011/074330 on which this application is based.
(Continued)

*Primary Examiner* — Richard Edgar
(74) *Attorney, Agent, or Firm* — Walter Ottesen, P.A.

(57) ABSTRACT

A turbomachine has a housing which has at least one inflow channel. A plurality of blades is arranged on a rotor wheel and an operating medium flows toward the blades. The operating medium flows via the inflow channel into at least one blade channel which is formed between two blades mounted on the rotor. After exiting the rotor region, the operating medium enters a diffuser. A guide body deflects the operating medium flowing out of the blade channel in the direction of the diffuser. A portion of the guide body in the turbomachine is positioned in an intermediate region of the rotor. The intermediate region is surrounded in the radial direction by the rotor blades and lies between a blade-channel outlet and an inlet opening in an outlet channel which is downstream of the rotor and is formed by the diffuser.

17 Claims, 4 Drawing Sheets

(56) References Cited

U.S. PATENT DOCUMENTS 4,789,300 A * 12/1988 Swearingen ..... F01D 5/048
415/148
5,603,604 A 2/1997 Norris et al.
6,533,546 B2 3/2003 Kreitmeier

FOREIGN PATENT DOCUMENTS

JP 9-264106 A 10/1997
SU 595519 A1 2/1978

OTHER PUBLICATIONS

English translation and International Preliminary Report on Patentability dated Jul. 11, 2013 of international application PCT/EP2011/074330 on which this application is based.

* cited by examiner 10
11
1
51
22
21
52
60
25
4
25
34
29
61
62
63
3''
30
26
32
33
31
40
26
53
3

2
20
21
42
5

TURBOMACHINE

CROSS REFERENCE TO RELATED APPLICATIONS

This application is a continuation-in-part application of international patent application PCT/EP2011/074330, filed Dec. 30, 2011, designating the United States and claiming priority from German applications 20 2010 017 157.1 and 10 2010 056 557.1, both filed Dec. 30, 2010, and the entire content of the above applications is incorporated herein by reference.

FIELD OF THE INVENTION

The invention relates to a turbomachine, especially to a turbine, with a housing, which has at least one inlet passage, and with a rotor wheel which is rotatably mounted in the housing on a shaft and on which are arranged a plurality of blades onto which an operating medium can flow. The operating medium flows in via the inlet passage into at least one blade passage which is formed between two blades which are mounted on the rotor wheel.

The invention also relates to an energy conversion system which, for providing mechanical energy, makes use of a cycle process in which an operating medium, with the aid of a thermal turbomachine (turbine), is thermodynamically almost isentropically expanded.

BACKGROUND OF THE INVENTION

A turbomachine according to the prior art, which is designed as a radial turbine, is shown in FIG. 1 of the drawings herein. FIG. 1 is a section view of a portion of a conventional steam turbine in the form of a radial turbine which is designed for a steam flow below sonic velocity (subsonic flow). In a radial turbine, the corresponding operating medium flows in the radial direction with regard to a rotational axis of a rotor wheel and impinges upon the blades at the periphery of this rotor wheel. In the case of axial turbines, however, the operating medium flows in the axial direction with regard to a rotational axis of the rotor wheel. In the case of the turbine which is shown in FIG. 1, blade leading edges and blade trailing edges are formed, extending from the radial direction into the axial direction at an angle of 90°.

The turbomachine of FIG. 1, which is designed as a radial turbine, has an essentially fixed turbine housing 110, in which a turbine wheel 120 (rotor wheel) is arranged. The rotor wheel 120 comprises a multiplicity of (co-rotating) blades, wherein in FIG. 1 one blade 121 is shown as being representative. A gaseous operating medium, for example exhaust gas from an internal combustion engine, flows through an inlet passage or through a nozzle passage 100 of the turbine housing 110 according to a direction arrow 151 and drives the rotor wheel 120. To this end, the flowing operating medium is first accelerated in the nozzle passage 100 and deflected along a blade 121. The edges of the blade are oriented on one side in the region of an operating medium inlet parallel to the rotational axis of the rotor wheel 120 and at an operating medium outlet point 153 in the radial direction. The operating medium is guided in this case along its entire flow path in the rotor wheel between blades 121.

The rotor wheel 120 of the flow device (turbine) according to FIG. 1 is basically designed similar to the rotor wheel of a compressor, in which the operating medium which is driven through the blades flows in a direction which is oriented oppositely to the view according to FIG. 1. The flow in an operating state as a compressor can correspondingly be deflected inside the blades of the rotor wheel from the inside outwards in such a way that, after discharging from the blade passages at the operating medium outlet, the flow travels axially in relation to the rotor wheel. This type of construction of blade wheels or blading is well suited to operating medium or steam velocities below sonic velocity.

In the case of radial turbines according to the prior art, with rotor wheels in which the flow is deflected by 90° along its blading, difficulties arise if steam flows reach their sonic velocity.

A particular problem is that radial turbines for supersonic flows, with parallel blades which are oriented axially to the shaft, lead to vortex formation and consequently lose effectiveness.

SUMMARY OF THE INVENTION

It is therefore an object of the invention to provide a flow device of the type referred to above, with which higher efficiency and improved flow guidance are made possible.

Furthermore, it is an object of the invention to provide a system for energy conversion, especially for executing a cycle process, especially a so-called organic Rankine cycle process, the efficiency of which is improved, especially within the scope of the included expansion process.

The organic Rankine cycle process (ORC) is a process for energy conversion wherein, from a heat source for operating steam turbines, an operating medium other than water vapor is used. As operating medium, in most cases organic fluids at a lower evaporation temperature ($T_{evap}$<100° C.), rarely at a higher evaporation temperature, are used. The process is then used predominantly in energy generating systems and energy conversion systems if the available temperature drop between heat source and heat sink is too low for operating a turbine which is driven by water-steam.

The turbomachine of the invention includes: a housing defining a housing channel for conducting an inflow or an outflow of an operating medium; a diffuser defining a diffuser channel; a rotor wheel defining a rotational axis and positioned in the housing so as to rotate about the rotational axis; a plurality of blades mounted on the rotor wheel adjacent one to another so as to cause the blades to form a plurality of blade channels conjointly defining a blade channel opening facing toward the rotational axis for accommodating a through flow of the operating medium to the diffuser channel; the diffuser channel having a diffuser opening facing toward the rotor wheel; the blade channel opening and diffuser opening conjointly defining an intermediate region extending therebetween for conducting the operating medium from one of the openings to the other one of the openings; a guide body extending from the intermediate region into the diffuser channel for deflecting the operating medium flowing through the intermediate region; the guide body being arranged coaxially to the rotational axis; and, the guide body having a first side facing toward the rotational axis and a second side facing away from the rotational axis with the operating medium flowing over both of the first and second sides.

A turbomachine according to the invention has a housing with an inlet passage. Arranged in the housing, rotatably mounted on a shaft, is a rotor wheel which has a plurality of blades onto which the operating medium can flow.

A feature of a turbomachine according to the invention is that for deflecting the operating medium, which flows from a blade passage, in the direction of the outlet passage, a guide body, with at least one deflection element, is provided in the intermediate region between the blade passage outlet and the outlet passage. The operating medium preferably first of all flows into the rotor wheel via the inlet passage in the radial direction with regard to a rotational axis of the rotor wheel. The blades of the rotor wheel in this case form a lattice which rotates with the rotor wheel, is split in the circumferential direction of the rotor wheel, and in which the operating medium is deflected especially in the circumferential direction and is guided in the radial direction into the inside of the rotor wheel. Preferably, inlet openings of a plurality of straight or curved blade passages having an essentially rectangular cross section are formed between the radially outer edges of the blades and outlet openings of a plurality of straight or curved blade passages having an essentially rectangular cross section are formed between the radially inner edges of the blades. In this case, the inlet and outlet openings of a blade passage are arranged in each case according to the invention in planes which may be curved and which are parallel to each other or have an acute angle in relation to each other. More preferably, the (co-rotating) intermediate region according to the invention is arranged inside the rotor wheel in such a way that the intermediate region is encompassed in an annular manner, at least a portion thereof, by the outlet openings of a plurality of blade passages.

The guide body preferably has a deflection element in the form of a support structure, constructed in one piece with the rotor wheel shaft, with a rotational hyperboloidal or conical external contour (rotor wheel cone) which on its outer side serves for flow deflection. The guide body also has an annular deflection element in the form of an annular structure which is inserted, at least in part, into the intermediate region. According to the invention, a guide body with all the subsections can be connected to the rotor wheel so as to rotate therewith. Alternatively, a guide body can have fixed deflection elements which are connected to the housing.

With the arrangement of deflection elements within the blade wheel, a separation of the flow and a pressure loss associated therewith directly downstream of the blade wheel is minimized according to the invention. The effect of a possibly downstream-connected diffuser for additional efficiency enhancement is improved. This is especially achieved according to the invention when, by means of at least one annular deflection element, the flow of operating medium which discharges from the outlet openings of a plurality of blade passages (blade passage outlets) is once more split into a plurality of component flows which are separated from each other. According to the invention, component flows, which are separated from each other especially in the axial direction (with regard to the rotor wheel), are provided in this case and can be differently guided by means of different contours on the front side and rear side of a deflection element.

Furthermore, an annular deflection element, which extends into the intermediate region, can be fastened via a fastening ring on the housing of the turbomachine. The fastening ring is then preferably constructed as a disc-like lattice structure, exposable to throughflow, with radially extending spokes. In this case, the axial force acting upon the blade wheel, which results from the change of direction of the flow, is reduced.

According to another aspect of the invention, the turbomachine is designed as a compressor, in which the operating medium, for function-related reasons, flows against the flowing direction in a turbine.

In one embodiment of the invention, the operating medium flows into the rotor wheel in the radial direction (with regard to the rotational axis of the rotor wheel) via a widening inlet passage. A constriction is preferred in the region of the inlet passage for the flow of the operating medium in order to be able to achieve supersonic velocity in the region of the inlet passage.

According to one embodiment of the invention, the guide body has a deflection element with a first and a second annular edge, wherein the first annular edge of the deflection element is positioned adjacent to the blade passage outlet and wherein the second annular edge is positioned adjacent to the diffuser passage inlet. As a result of this, an advantageous outflow of the operating medium from the rotor wheel is achieved. The consequence is that a vortex formation in the outlet region of the flow device or in the diffuser inlet region is prevented as a result.

In a further embodiment of the invention, the deflection element is formed in such a way that the first edge is a leading edge and points in the radial direction (with regard to the rotor wheel), whereas the second edge is a trailing edge and points in the same direction as the rotational axis so that as a result the operating medium which flows from the blade passage is deflected from the radial direction into the axial direction. As a result of this, the efficiency of the turbomachine is improved. The guide body preferably has a plurality of spaced-apart deflection elements.

According to a further embodiment of the invention, the deflection element comprises a side facing the rotor wheel and a side facing away from the rotor wheel. The deflection element is positioned in this case in such a way that operating medium can flow around it on both sides. Annular passages for the operating medium are correspondingly provided on both sides of the deflection element. More preferably, the annular deflection element is arranged in a manner in which operating medium can flow around it approximately on all sides. More preferably, the annular deflection element, at least in sections, has a droplet-shaped, half-moon-shaped, or airfoil-shaped cross-sectional geometry. As a result of this, an advantageous deflection of the operating medium in the region of the rotor wheel takes place. As a result, a particularly efficient operation of the flow device is made possible.

In a further embodiment of the invention, the guide body has a plurality of spaced-apart deflection elements which together form a lattice, with annular passages, through which a flow can pass. As a result, the overall flow of the operating medium is split into a plurality of annular component flows. Inside such a lattice consisting of deflection elements, the overall flow can be effectively deflected, wherein the individual component flows which are formed can be subjected to different treatments by the contours of the deflection elements being designed differently from each other. Additional flow-guiding elements such as turbulence promoters, surface coatings or the like can in turn be arranged on the deflection elements. The same effect can basically be achieved even when using only one deflection element.

In a further embodiment of the invention, the spaced-apart deflection elements are positioned in such a way that their edges which face the blades of the rotor wheel are at an axial distance in the axial direction. At the same time, the edges which face the blades of the rotor wheel have at least approximately the same (outside) diameter which in turn is at most 10% smaller than a (common) diameter of the inner edges of the rotor wheel blades. Therefore, an appreciable merging of the component flows of operating medium which emerge from the blade passages is prevented. Rather, the component flows which are separated in the circumferential direction of the rotor wheel are split once more in the guide body in the axial direction (with regard to the rotor wheel). This can naturally also be achieved when using only one deflection element.

In a further embodiment of the invention, the spaced-apart deflection elements are positioned in such a way that their edges which point in the direction of the rotational axis of the rotor wheel are at a different radial distance with regard to the rotational axis of the rotor wheel. As a result, different component flows of the operating medium with different radial spacings are let into a downstream-connected diffuser and unwanted vortices are minimized.

According to a further aspect of the invention, a plurality of permanent magnets and/or rotor windings are arranged on a shaft which is connected to the rotor wheel and together with a plurality of adjacently arranged stator windings, which surround the shaft, form an electric generator. Consequently, the turbomachine can be used as a "turbogenerator" for power generation.

A turbomachine according to the invention can especially be a thermal turbomachine. It is an idea of the invention, furthermore, to use a turbomachine according to the invention as a turbine, especially as a radial turbine, in an organic Rankine cycle process.

The invention therefore also extends to a system for converting energy with a cycle process in which a turbomachine according to the invention is used. In particular, the invention refers to a radial turbine for a system for converting energy in the form of a so-called ORC system. A system in which a thermodynamic cycle process in the form of an "organic Rankine cycle" (ORC) is executed and with which heat can be converted into mechanical energy is referred to as an ORC system in this case.

The heat which is fed to an ORC system according to the invention can originate from a heat source in the form of an internal combustion engine, from a combined heat and power system, from a biomass firing system, from a geothermal source or from a solar power system, for example. By means of an ORC system, each form of waste heat can be utilized. For example, electric energy can additionally be produced from the waste heat of internal combustion engines by means of an ORC system.

An ORC system according to the invention can contain a condenser for liquefying an operating medium of the system, a pump, and an evaporator for evaporating the operating medium. In such a system, there is a turbomachine, especially a turbine, connected downstream to the evaporator, in which the operating medium is expanded, extracting kinetic energy from the cycle.

The pump brings an operating medium, which is liquid under normal conditions, to operating pressure. The still-liquid operating medium subsequently flows through the heat exchanger (evaporator) or even through a heat exchanger system in which thermal energy, for example from one of the aforesaid sources, is transferred to the operating medium of the ORC system. As a result of the energy yield, the operating medium evaporates, preferably completely. At the outlet of the evaporator, saturated steam or dry steam is then produced. As a result of the energy yield in the evaporator, the specific volume and the temperature of the steam increase.

The steam of the operating medium is expanded almost isentropically to a lower pressure via a turbomachine according to the invention in the form of a turbine. The specific volume then increases as a result of the expansion in the turbine. This volume increase, brought about by the pressure differential and the work resulting therefrom, is referred to as change in volume work which the turbine converts by its blades into mechanical energy.

From the turbine, if necessary the steam flows through a regenerator in which an exchange of heat between the vaporous operating medium and the liquid operating medium coming from the pump takes place (internal heat exchange).

The (still-vaporous) operating medium which is brought to condensation temperature in the turbine and in the regenerator, if applicable, finds its way into the downstream-connected condenser in which the operating medium is recondensed, yielding low-temperature heat. The heat which is yielded during the condensation is preferably additionally fed via a cooling water circuit into a heat network. The operating medium condenses out and converts again completely into the liquid aggregate state. The feed pump (pump) subsequently brings the operating medium to operating pressure and then introduces it again into the evaporator. As a result, the cycle is completed.

By a flow device according to the invention which is used as a turbine in an ORC system, a generator can especially be driven and generates electric current from mechanical energy which is produced by the turbine from thermal energy.

Such an ORC system with a turbomachine (turbine) according to the invention can be used both for small and large domestic systems and for large industrial systems and also for power systems. Energy supplies, for example air-conditioning systems for offices, garages, hospitals and all types of buildings, are to be understood by domestic systems in this case. Industrial systems are, for example, manufacturing systems, especially manufacturing systems of the automobile industry, especially paint shops, in which a balanced requirement for power (from mechanical energy) and heat at different temperature levels is required.

Further advantages, features and details of the invention are gathered from the subsequent description of a plurality of preferred exemplary embodiments and also with reference to the drawings.

The aforesaid features and feature combinations in the description and also the features and feature combinations which are subsequently referred to in the figure description and/or shown alone in the figures are applicable not only in the respectively disclosed combination but also in other combinations or in isolation without departing from the scope of the invention.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
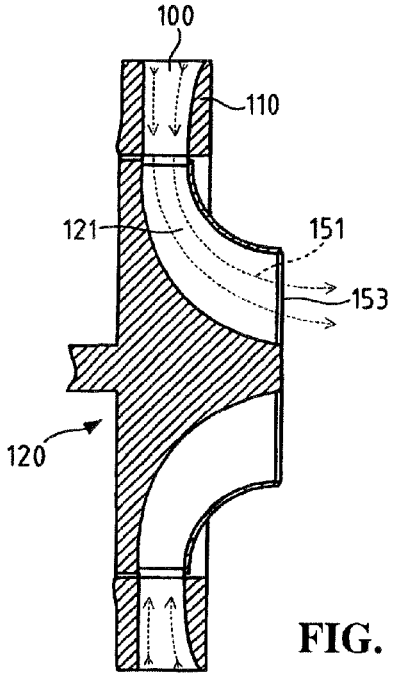
FIG. 1 is a section view of a portion of a steam turbine in the form of a radial turbine as known from the prior art.
Figure 2:
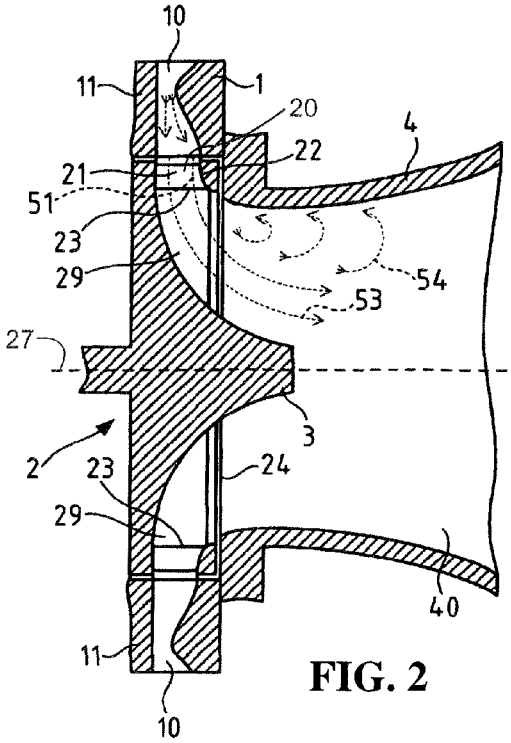
FIG. 2 shows a section view of a radial turbine for supersonic flow with a deflection element in the form of a rotational hyperboloid (blade wheel cone) for deflecting the flow inside the rotor wheel.

FIG. 2 shows a section view of a turbomachine according to the invention in the form of a radial turbine with an essentially fixed turbine housing (1, 4, 11), in which a turbine wheel 2 (rotor wheel) is arranged. The turbine housing (1, 4, 11) especially comprises a nozzle ring 1 and also an associated shroud 11. The shroud 11 and the nozzle ring 1 are preferably constructed as separate sub-assemblies. The nozzle passages 10 are formed between the shroud and the nozzle ring. The turbine housing (1, 4, 11) comprises a diffuser 4 with a diffuser passage 40 for the operating medium.

The rotor wheel 2, which is arranged in the turbine housing, comprises a multiplicity of (co-rotating) blades. Shown in FIG. 2 is the rotor wheel 2 with a blade 21. Formed between the blades of the rotor wheel 2 are straight or curved blade passages 20 (see FIG. 5*b*) which have an essentially rectangular cross section. The blades are interconnected via a base of the rotor wheel 2 and also, on a side at a distance therefrom, via a so-called banding 22.

A vaporous operating medium, for example the operating medium of an ORC system, flows through a nozzle passage 10, acting as an inlet passage, of the turbine housing 11 according to a direction arrow 51. In the nozzle passage 10, the flowing operating medium is accelerated via a corresponding nozzle geometry so that sonic velocity is achieved at a constriction, wherein the operating medium can be brought to supersonic velocity before a transition into the rotor wheel 2.

The vaporous operating medium flows from the nozzle passage 10 and impinges upon the blade 21 which is designed in such a way that both the flow-impinged edge and the edge of the blade 21 lying in the outflow direction, and therefore also this blade itself, are oriented parallel and axially to the rotor wheel shaft. A first portion of the flow of operating medium is indicated by directional arrow 51 and a second portion is indicated by directional arrow 53. After passing through the blades 21 as shown by directional arrows (51, 53) or, more specifically, through corresponding blade passages between a plurality of blades 21 (and therefore into a so-called intermediate region 29 of the rotor wheel 2), the operating medium is deflected (change of orientation of arrows 51, 53) for achieving parallelity with the rotational axis 27 of the rotor wheel. To this end, provision is made according to the invention for a guide body 3 in the form of a conical deflection element (rotor wheel cone) which is preferably designed as a rotational hyperboloid. This deflection element can be optionally constructed in one piece with the rotor wheel. The guide body 3 is located in an intermediate region 29 between the blade passage outlets 23 and the inlet opening 24 into the diffuser passage 40 which is formed by the diffuser 4. The deflection element, which is formed as a rotor wheel cone, with the guide body 3, is arranged in this case in the region of its base in the intermediate region 29 within the rotor wheel 2. A section of the guide body is encompassed in an annular manner by the blade passage outlets 23 or by the blades 21 of the rotor wheel. The guide body 3 extends into the diffuser passage 40 which is formed by the diffuser 4.

The rotor wheel cone brings about a largely laminar flow deflection at moderate flow velocities. At high flow velocities, vortices 54 can arise.

For avoiding the effect of vortex formation shown in FIG. 2, a reduction of the vortex formation can be achieved by the positioning of guide bodies in the outflow passage, that is, in the diffuser 4 downstream of the rotor wheel 2.

Figure 3:
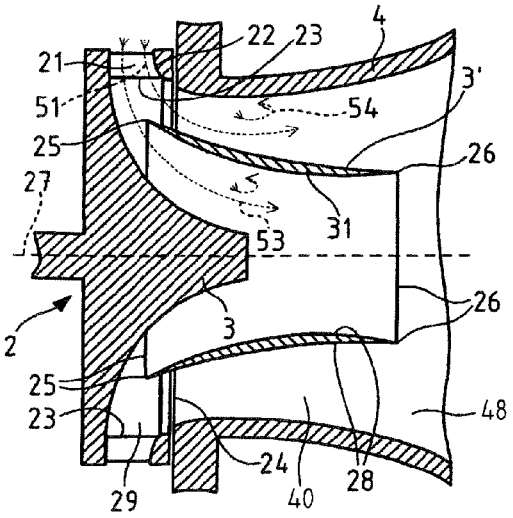
FIG. 3 shows a section view of a rotor wheel of a radial turbine for supersonic flow with a guide body, projecting in sections into the rotor wheel, for reducing the vortex formation in a downstream-connected diffuser.

A further flow device according to the invention is shown in FIG. 3 which is constructed basically in a similar way to the flow device according to FIG. 2. Reference can be made to the previous description for FIG. 2 accordingly. Similar constructional elements and functional units are also provided with the same reference numerals. The flow device according to FIG. 3, in addition to a first deflection element in the form of the co-rotating rotor wheel cone, comprises a second deflection element 31 in the form of an annular guide body 3' which is mounted on the housing side. The annular guide body 3' preferably reaches into an intermediate region 29 of the rotor wheel 2 which is surrounded by the rotor wheel blades 21. As a result, the flow of operating medium which emerges from the rotor wheel blade passages can be split into two annular component flows at an early stage.

The annular guide body 3' has a first and a second annular edge (25, 26). The first edge 25 of the deflection element is positioned adjacent to the blade passage outlet 23 inside the intermediate region 29. The second edge 26 is arranged facing away from the inlet opening 24 and is within the outlet passage 48. The first edge 25 acts in this case as a leading edge. The second edge 26 is a trailing edge. The deflection element 31 is designed with a guiding contour 28 which extends from the first edge 25, from a direction which is approximately radial to a rotational axis 27 of the rotor wheel 2, to the second edge 26, in a direction which is approximately axial to the rotational axis 27 of the rotor wheel 2. The operating medium which flows from the blade passage 20 is therefore deflected by the deflection element 31 from an essentially radial direction into an essentially axial direction. In modified exemplary embodiments, other flow directions can also be provided by the contours of the deflection elements being oriented in the corresponding directions.

If, despite the described measures, residual vortices 54 arise, for example at particularly high flow velocities, further improvements can be alternatively or additionally provided according to the invention.

In particular, radial turbines are frequently used in ORC systems for converting the flow energy of the operating medium into torque. Because of the low sonic velocity in such media and the high pressure ratios between inlet and outlet of the steam into and out of the turbine, the flow velocity of the steam in the rotor wheel of the turbine frequently lies above sonic speed. Also, the outlet velocity of the steam from the rotor wheel frequently lies above Mach 0.7. Taking into consideration the geometrically predetermined large difference between the curvature radius of the rotor wheel cone and of the inner edge of a banding 22 over the blades 21, and also as a result of the high outflow velocity, a uniform outflow of the vaporous operating medium in turbines of ORC systems is frequently prevented.

Figure 4:
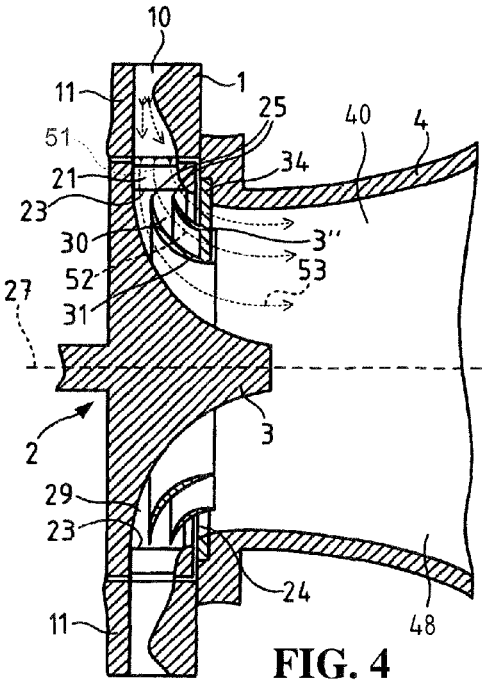
FIG. 4 shows a section view of a flow device with guide bodies which lie mainly inside the rotor wheel.
Figures 5A, 5B:
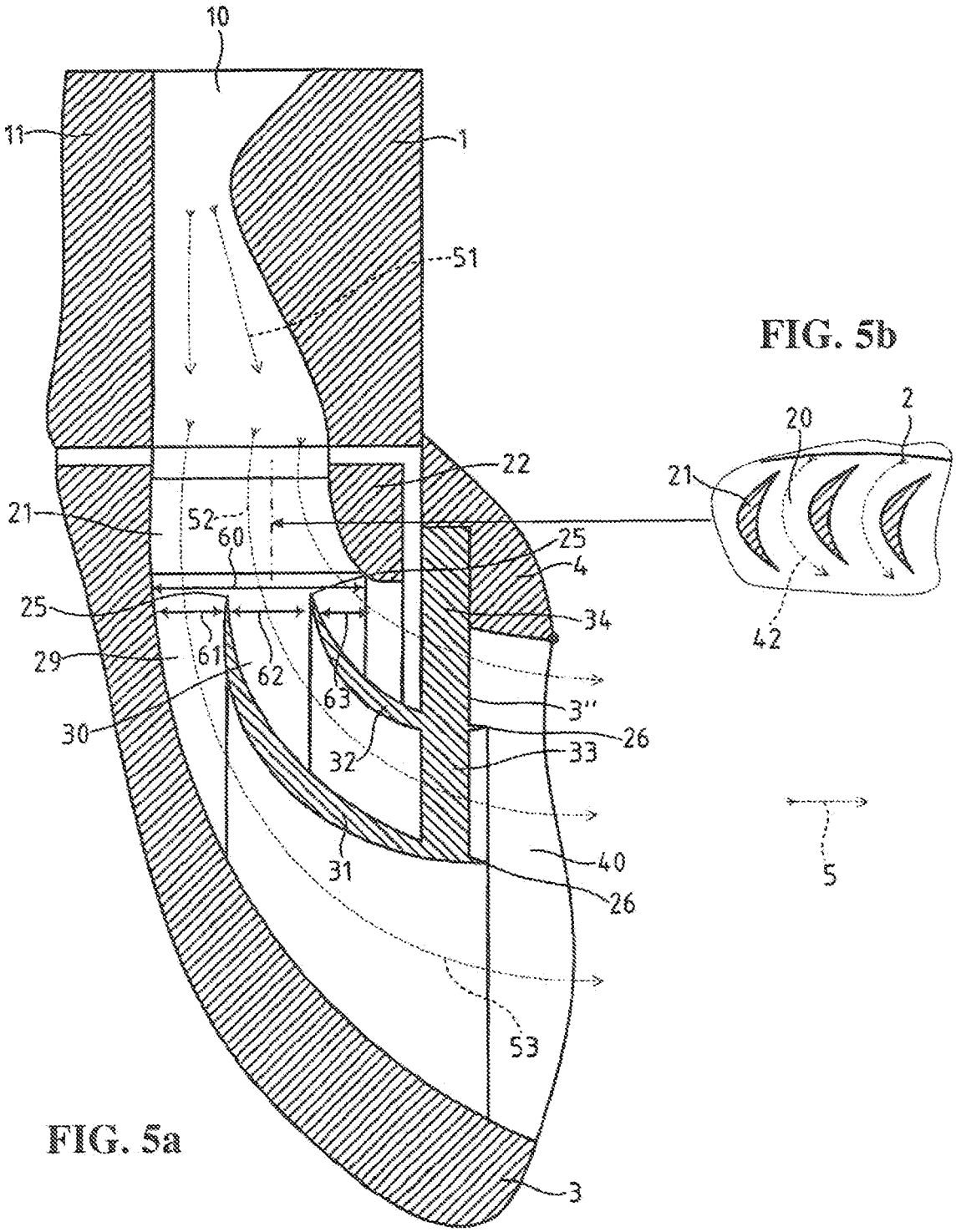
FIG. 5*a* shows in an enlarged section view a section of the flow device according to FIG. 4.
FIG. 5*b* shows a view of blades of the rotor wheel of the flow device according to the invention from FIG. 5*a*, which for illustrating their geometry are shown transversely to the blade axis.

Shown in FIGS. 4, 5*a* and 5*b* are details of a further turbomachine according to the invention, designed as a radial turbine, which has a nozzle ring 1 with a nozzle shroud 11, a rotor wheel 2 mounted on a shaft in a housing, a nozzle passage 10, a diffuser 4, a plurality of blades 21 which are arranged on the rotor wheel 2, a first lattice-like guide body 3" and a second conical guide body 3. A basic principle of operation corresponds to that of the radial turbine according to FIG. 2 or FIG. 3 so that reference can be made to the embodiments corresponding thereto.

A vaporous operating medium can be directed via the nozzle passage 10 to a wheel inlet of the rotor wheel according to a direction arrow 51. The working medium impinges upon the blades 21 there and flows between the blades 21 into a blade passage 20 according to a direction arrow 42 (FIG. 5*b*). The inflow onto the blades 21 is carried out in the radial direction with regard to a rotational axis of the rotor wheel 2. After flowing through the blade passage 20, the operating medium finds its way into an intermediate region 29 between a blade passage outlet and an outlet passage 48 downstream of the rotor wheel 2. The first guide body 3" and the second guide body 3 are positioned according to the invention in the intermediate region 29 downstream of the blade passage outlet and an inlet of diffuser passage 40, wherein both guide bodies can preferably also project with a portion thereof from the intermediate region into the outlet passage 48 of the diffuser.

According to FIG. 5*a*, the first guide body 3", in addition to an also lattice-like fastening ring 34 which is especially provided with radial spokes and through which flow can pass, comprises two circular annularly-shaped deflection elements 31 and 32, wherein in alternative exemplary embodiments more than two deflection elements can be used. Alternatively, a single annular deflection element 31 can also be provided. The annular deflection elements (31, 32) are preferably constructed together with the fastening ring 34 in one piece and so form the first guide body 3" which can also be referred to as a flow lattice. The first guide body 3" which is constructed in this way interacts with the second guide body 3 in the form of the rotor wheel cone. Both guiding components (3, 3"), interacting, split the intermediate region 29 of the rotor wheel 2, at least in sections, into circular annular flow passages which are separated from each other.

The operating medium is consequently split a number of times directly downstream of the blades 21 by the deflection elements 31 and 32 of the first guide body 3" and for the most part is guided still inside the blade wheel 2 parallel to its rotational axis according to a direction arrow 53.

The first guide body 3" extends between a first edge 25 and a second edge 26 of a deflection element 31 or 32 and is designed in such a way that the first edge is positioned adjacent to the blade passage outlet; whereas, the second edge 26 is positioned adjacent to the outlet passage 48.

The deflection element (31, 32) is designed in such a way that the first edge 25 serves as a leading edge and points in the radial direction to the rotational axis of the rotor wheel 2; whereas, the second edge 26 is a trailing edge and points in the same direction as the rotational axis so that the operating medium which flows from the blade passage 20 is deflected from a radial direction into an approximately axial direction. In this case, both deflection elements (31, 32) have in each case a side facing the rotor wheel 2 and a side facing away from the rotor wheel 2. The deflection elements (31, 32) are especially positioned in such a way that operating medium can flow around them on both sides.

As a consequence of this, the operating medium, after issuing from the blade passage 20, is deflected into the diffuser passage 40 in such a way that a flow along the rotor wheel 2 is optimized.

The deflection elements 31 and 32 of the first guide body 3" preferably have half-moon-shaped cross-sectional contours, wherein their profile is of a flow-favorable design. The first edge (annular leading edge), pointing towards the rotor wheel 2, points radially away from the center. The second edge (annular trailing edge) which is located on the axially opposite end points away from the base of rotor wheel 2. The curvature of the profile of the deflection elements is designed so that the operating medium is deflected continuously to be oriented in the end parallel to the rotational axis of the rotor wheel 2.

If several annular deflection elements (31, 32) are used in the guide body 3", then the trailing edges of these deflection elements (31, 32) have different diameters with regard to the rotational axis of the rotor wheel 2; whereas, it is practical that the leading edges have the same diameter with respect to a rotational axis of the rotor wheel 2. The leading edges are preferably positioned as close as possible to the trailing edges of the blades 21. To this end, it is advisable that the (essentially equal) diameters of the leading edges of the deflection elements (31, 32) have a diameter which is less than 10% smaller than the diameter of that circle which is touched by all the trailing edges of the blades.

According to FIG. 5*a*, each blade 21 has a blade height 60 inside the rotor wheel 2 at the blade passage outlet. A first axial distance 61 between a surface of the rotor wheel base and the leading edge of the first deflection element 31 is in this case less than an axial distance between the leading edge of the second deflection element 32 and the same surface of the rotor wheel base so that an axial distance 62 exists between the leading edges of both deflection elements (31, 32). Also, the leading edge of the deflection element 32 is arranged at an axial distance 63 from the banding 22.

Furthermore, the deflection elements (31, 32), which are adjacent to each other, are positioned in such a way that their trailing edges 26 are at a different radial distance with respect to the rotational axis of the rotor wheel 2. Also, the leading edges, pointing towards the blades of the rotor wheel, have a different axial distance 61 or distance 61+62 from the rotor wheel base in the axial direction.

The rotor wheel 2 is the rotating part of the turbomachine or of the radial turbine which either extracts work from the flowing medium when the turbomachine is being used as a turbine or supplies work when the turbomachine is being used as a compressor. The rotor wheel 2 is connected to a shaft, which is not shown, via which generated mechanical energy is delivered.

In the diffuser 4, which is arranged downstream to the guide body 3, the gas flow is decelerated by widening the flow cross section and the static gas pressure is increased. The diffuser 4, in principle, represents the reverse of a nozzle.

A banding 22, which is shown in FIG. 5*a*, is arranged on the blades 21 and serves for stabilizing the rotor wheel 2 and for maintaining the rotor in a deformation-free state.

The guide body 3", more specifically, the deflection elements 31 or 32 are connected via ribs 33 preferably to the turbine housing or to the diffuser 4 of the turbine so that the forces which act on account of the deflection of the operating medium are not transferred to the rotor wheel shaft. The guide body 3" is the counterpart to the moving rotor wheel 2. The guide body 3" is preferably formed in a manner fixed to the housing or on the diffuser 4 via the ribs 33. Therefore, the rotor wheel 2 and the guide body 3" conjointly form a stage. For attaching the deflection elements on the diffuser 4, provision is made at the diffuser inlet for a fastening ring 34 of the guide body 3".

It is also possible to fasten the deflection elements 31 or 32 on the rotor wheel 2 so that these then co-rotate. Alternatively, one deflection element can be fastened on the rotor wheel and another on the housing.

The guide body 3" or the deflection elements 31 and 32 in a turbomachine according to the invention are preferably produced from high-grade steel and are manufactured by metal-cutting machining processes. These, however, can basically also be produced from cast metal (cast aluminum, cast steel, gray cast iron).

The turbomachine is preferably used as a radial turbine in an ORC system for executing an organic Rankine cycle process.

In the sense of the invention, a turbine system is especially also referred to as a turbomachine, in which a vaporous operating medium flows in under pressure, is expanded in a fixed nozzle system, also with guide blading, and accelerated in the process. Downstream of the nozzle system, the steam is deflected therein by a rotating blade system, possibly further expanded, and in so doing yields its flow energy via the blades to a shaft which is connected or coupled to the blades. From this shaft, the mechanical rotational energy is then transmitted to a consumer or to a device for the conversion of energy for further utilization. For example, devices for the conversion of energy in the form of generators for power generation can be driven by the shaft.

The invention, by means of simple and inexpensive guide bodies, achieves an efficiency increase of radial turbines. With a turbomachine according to the invention, the efficiency of an ORC system can thus be improved.

Figure 6:
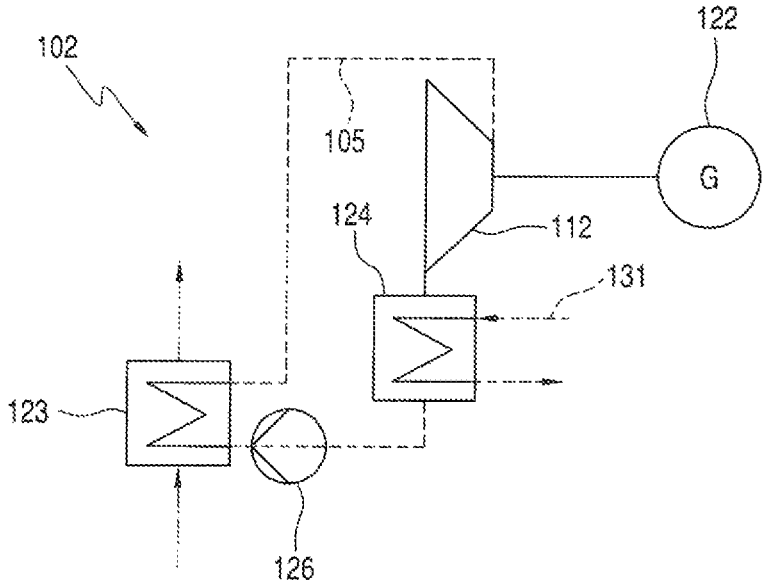
FIG. 6 is a schematic of an ORC system incorporating a turbomachine configured according to any one of the embodiments shown in FIGS. 2 to 5*b*; and, FIG. 7 is a schematic of a generator having a shaft connected to the rotor wheel of a turbomachine of any one of the embodiments shown in FIGS. 2 to 5*b*.

FIG. 6 shows an ORC system 102 having a turbomachine 112 which is driven as a steam turbine and which is arranged in an operating medium circulatory loop. For example, butane, toluene, silicone oil, ammonia, methylcyclohexane or even ethylbenzene can be used as a fluid operating medium. The turbomachine 112 can, for example, correspond to one of the embodiments shown in FIGS. 2 to 5*b*.

A generator 122 is coupled to the turbomachine 112. The ORC system 102 includes an operating medium condenser 124 and a feed pump 126 which operates as an operating medium pump. The fluid operating medium in the liquid aggregate state is brought to operating pressure by the feed pump 126. The liquid operating medium flows through a heat exchanger 123 which operates as a vaporizer and vaporizes the operating medium. Saturated vapor, or even dry steam, is made available at the output of the heat exchanger 123.

The specific volume and the temperature of the vapor increase because of the energy input into the heat exchanger 123. The vapor of the operating medium is then expanded almost isentropically to a lower pressure via the turbomachine 112 connected to a generator 122. In this way, the specific volume increases because of the expansion. The volume increase of the operating medium associated therewith is caused by the pressure difference. This volume increase effects a resulting work in the form of a volume changing work which is converted into mechanical energy by the turbomachine 112 at its blades. The turbomachine 112 drives the generator 122.

The vapor travels from the turbomachine 112 into the operating medium condenser 124 which is a heat exchanger. A coolant circulation loop 131 is guided through the heat exchanger which contains a coolant. The heat, which is given off by the condensation, is fed, for example, into a heat network (not shown) via the coolant circulation loop 131. Alternatively to this, it is also possible to release the heat of the coolant, which is conducted in the coolant line 131, to ambient air via a heat exchanger.

The heat exchanger operates as an operating medium condenser 124 and the operating medium condenses therein and transitions completely into the liquid aggregate state. With the feed pump 122, which operates as an operating medium pump, the operating medium is then again brought to operating pressure and arrives anew in the heat exchanger 123 operating as a vaporizer. The circulatory loop for the operating medium is then closed in the ORC system 102.

Figure 7:
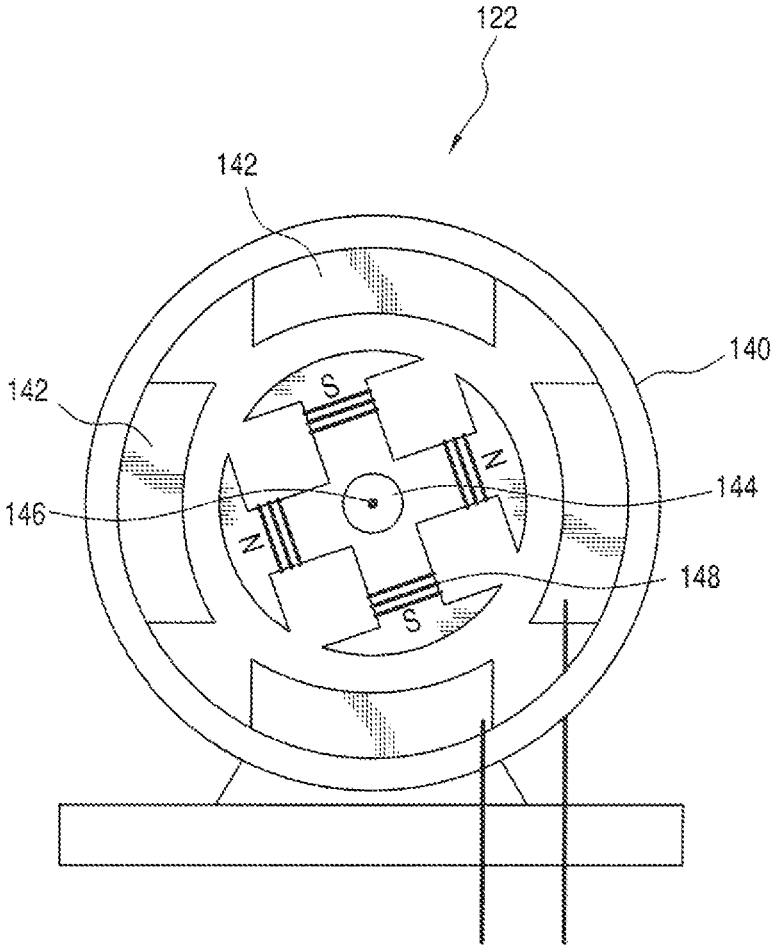

The generator 122 is shown in FIG. 7 and includes a stator 140 having a plurality of stator windings 142. A shaft 144 is connected to the rotor wheel 2 of the turbomachine 112 and rotates about longitudinal axis 146. A plurality of permanent magnets and/or rotor windings 148 are mounted on the shaft 144. The stator windings 142 are arranged one next to the other surrounding the shaft 144. The permanent magnets and/or rotor windings 148 and the stator windings 142 conjointly define the generator.

In summary, the following preferred features of the invention are especially to be emphasized: a turbomachine, especially a turbine, comprises a housing (1, 4, 11) which has at least one nozzle passage 10. In this case, a plurality of blades 21, onto which flows an operating medium, are arranged on a rotor wheel 2. The operating medium in this case flows via the nozzle passage 10 into at least one blade passage 20 which is formed between two blades 21 which are mounted on the rotor wheel 2. After issuing from the rotor wheel region, the operating medium enters a diffuser 4. In this case, at least one guide body (3, 3', 3") is provided for deflecting the operating medium, which flows from the blade passage 20, in the direction of the diffuser 4. The guide body in the turbomachine is preferably positioned, at least in part, in an intermediate region 29 of the rotor wheel, which is encompassed by the rotor wheel blades in the radial direction and lies between a blade passage outlet 23 and an inlet opening 24 in an outlet passage 48 which is connected downstream to the rotor wheel 2 and formed by the diffuser 4. The invention also refers to a system for executing an organic Rankine cycle process with such a turbomachine.

It is understood that the foregoing description is that of the preferred embodiments of the invention and that various changes and modifications may be made thereto without departing from the spirit and scope of the invention as defined in the appended claims.

LIST OF DESIGNATIONS

1 Nozzle ring
1, 4, 11 Turbine housing
2 Rotor wheel
3 Guide body on rotor wheel 2
3' Annular guide body disposed in diffuser 4
3" Lattice-like guide body
4 Diffuser
5 Flow direction
6 Distances
10 Nozzle passage
11 Shroud of the nozzles
20 Blade passage
21 Blade
22 Banding on blade
23 Blade outlet
24 Inlet opening
25 Edge
26 Edge
27 Rotational axis
28 Guiding contour
29 Intermediate region inside the rotor wheel
30 Passage between guide bodies
31, 32 Deflection elements
33 Connecting rib connecting guide body 3" to the turbine housing or diffuser 4
34 fastening ring of the guide bodies at the diffuser inlet
40 Diffuser passage
42 Directional arrow indicating flow between the blades 21 of the rotor wheel 2
48 Outlet passage of diffuser
51 Directional arrow indicating flow of operating medium

52 Directional arrow indicating flow through blade passages
53 Directional arrow showing flow of operating medium
54 Vortices
60 Blade height at the blade passage outlet of the rotor wheel
61 Axial distance between rotor wheel disc and deflection element
62 Axial distance between two deflection elements 31 and 32
63 Axial distance between deflection element 32 and banding 22
100 Nozzle passage
102 ORC system
110 Turbine housing
112 Turbomachine
120 Turbine wheel, rotor wheel
121 Blade
122 Generator
123 Heat exchanger
124 Operating medium condenser
126 Feed pump
131 Coolant Circulation Loop
140 Stator
142 Stator windings
144 Shaft
146 Longitudinal axis
148 Permanent magnets and/or rotor windings
151 Direction angle
153 Operating medium outlet

What is claimed is:

1. A turbomachine comprising:

a housing defining a housing channel for conducting an inflow or an outflow of an operating medium;

a diffuser defining a diffuses channel;

a rotor wheel defining a rotational axis and positioned in said housing so as to rotate about said rotational axis;

a plurality of blades mounted on said rotor wheel adjacent one to another so as to cause said blades to form a plurality of blade channels conjointly defining a blade channel opening facing toward said rotational axis for accommodating a through flow of said operating medium to said diffuser channel;

said diffuser channel having a diffuser opening facing toward said rotor wheel;

said blade channel opening and said diffuser opening conjointly defining an intermediate region extending therebetween for conducting said operating medium from one of said openings to the other one of said openings;

a guide body extending from said intermediate region into said diffuser channel for deflecting the operating medium flowing through said intermediate region;

said guide body being arranged coaxially to said rotational axis; and, said guide body having a first side facing toward said rotational axis and a second side facing away from said rotational axis with said operating medium flowing over both of said first and second sides.

2. The turbomachine of claim 1, wherein said guide body is fixed to said housing.

3. The turbomachine of claim 1, wherein said rotor wheel has a conical configuration projecting into said guide body for the deflection of said operating medium.

4. The turbomachine of claim 3, wherein said conical configuration is shaped as a rotational hyperboloid.

5. The turbomachine of claim 1, wherein said guide body includes a plurality of annularly-shaped deflecting elements with the operating medium passing over both sides of each element and wherein said deflecting elements are arranged coaxially to said rotational axis of said rotor wheel.

6. The turbomachine of claim 1, wherein said housing channel for the inflow or outflow of said operating medium is widened facing toward said rotor wheel.

7. The turbomachine of claim 1, wherein the operating medium flows onto said rotor wheel via over said housing channel or via in said housing channel and flows from said rotor wheel in a radial direction to said rotational axis.

8. The turbomachine of claim 1, wherein said guide body includes a deflecting element having a first annularly-shaped edge and a second annularly-shaped edge; and, said first annularly-shaped edge is positioned next to said blade channel opening and said second annularly-shaped edge is arranged next to said diffuser opening of said diffuser channel.

9. The turbomachine of claim 8, wherein said first annularly-shaped edge is an edge facing into the flow and said second annularly-shaped edge faces away from the flow.

10. The turbomachine of claim 8, wherein said deflecting element is configured to have a guiding contour extending from said first annularly-shaped edge from a direction, which is radial to said rotational axis, to said second annularly-shaped edge in a direction axial to said rotational axis so as to deflect the operating medium flowing from one of said blade channels to said diffuser channel from a radial direction into the axial direction or so as to deflect the operating medium flowing out from said diffuser channel to one of the blade channels from the axial direction into the radial direction.

11. The turbomachine of claim 1, wherein said guide body has several mutually spaced deflecting elements conjointly defining a through-flow lattice wherein the total flow of said operating medium is subdivided into several annular-shaped component flows.

12. The turbomachine of claim 11, wherein at least one of said deflecting elements has a droplet-shaped, half-moon shaped or airfoil shaped cross-sectional geometry.

13. The turbomachine of claim 11, wherein said deflecting elements have respective first edges facing toward said blades and are positioned so as to cause said first edges to have an axial spacing from each other in the axial direction of said rotational axis.

14. The turbomachine of claim 13, wherein said deflecting elements have respective second edges facing in the direction of said rotational axis; and, said second edges are disposed at respectively different radial distances from said rotational axis.

15. The turbomachine of claim 14, wherein the radial distance of the first edge of each one of said deflecting elements from said rotational axis is greater than the radial distance of said second edge of said one deflecting element from said rotational axis.

16. The turbomachine of claim 1, further comprising a shaft connected to said rotor wheel and a plurality of permanent magnets and/or rotor windings mounted on said shaft; and, a stator having a plurality of stator windings arranged one next to the other surrounding said shaft; and, said permanent magnets and/or rotor windings and said stator windings conjointly defining a generator.

17. A system for carrying out an organic Rankine cycle process, the system comprising:

a condenser for liquefying an operating medium circulating through said system;

a pump;

an evaporator for evaporating said operating medium; and, a turbomachine connected to said evaporator downstream thereof; and, said turbomachine being configured to expand said operating medium and to take energy from said cycle;

said turbomachine including:

a housing defining a housing channel for conducting an inflow or an outflow of an operating medium;

a diffuser defining a diffuser channel;

a rotor wheel defining a rotational axis and positioned in said housing so as to rotate about said rotational axis;

a plurality of blades mounted on said rotor wheel adjacent one to another so as to cause said blades to form a plurality of blade channels conjointly defining a blade channel opening facing toward said rotational axis for accommodating a through flow of said operating medium to said diffuser channel;

said diffuser channel having a diffuser opening facing toward said rotor wheel;

said blade channel opening and said diffuser opening conjointly defining an intermediate region extending therebetween for conducting said operating medium from one of said openings to the other one of said openings;

a guide body extending from said intermediate region into said diffuser channel for deflecting the operating medium flowing through said intermediate region;

said guide body being arranged coaxially to said rotational axis; and, said guide body having a first side facing toward said rotational axis and a second side facing away from said rotational axis with said operating medium flowing over both of said first and second sides.

* * * * *